US006036457A

United States Patent [19]

Sekita et al.

[11] Patent Number: 6,036,457

[45] Date of Patent: Mar. 14, 2000

[54] RELIEF VALVE WHICH DOES NOT PROTRUDE BEYOND A COMPRESSION HOUSING

[75] Inventors: Masumi Sekita; Makoto Takeuchi, both of Nagoya; Shigeki Miura, Aichi-ken, all of Japan

[73] Assignee: Mitsubishi Heavy Industries, Ltd., Tokyo, Japan

[21] Appl. No.: 08/964,859

[22] Filed: Nov. 5, 1997

[30] Foreign Application Priority Data

Jan. 17, 1997 [JP] Japan ..... 9-019722

[51] Int. Cl.[7] ..... F04B 23/00

[52] U.S. Cl. ..... 417/440; 417/307

[58] Field of Search ..... 417/440, 307, 417/310; 251/366, 367; 137/454.5

[56] References Cited

U.S. PATENT DOCUMENTS

| | | | |
|---|---|---|---|
| 848,641 | 4/1907 | Dudgeon | 137/454.5 |
| 2,172,311 | 9/1939 | Thomas | 137/454.5 |
| 4,505,651 | 3/1985 | Terauchi et al. | 417/440 |
| 4,840,544 | 6/1989 | Kuromitsu et al. | 417/254 |
| 4,940,395 | 7/1990 | Yamamoto et al. | 417/310 |
| 5,362,210 | 11/1994 | Richardson | 417/307 |
| 5,800,133 | 9/1998 | Ikeda et al. | 417/269 |

FOREIGN PATENT DOCUMENTS 196 41 996A1 4/1997 Germany .

OTHER PUBLICATIONS

Patent Abstracts of Japan, vol. 97, No. 7, Jul. 31, 1997 [JP 09 060588 A (Toyota Autom Loom Works Ltd), Mar. 4, 1997].

*Primary Examiner*—Charles G. Freay
*Assistant Examiner*—Robert Z. Evora

[57] ABSTRACT

The dimension of a compressor is decreased, to facilitate the installation of the compressor in a limited space, by installing a relief valve (50) in such a manner that the relief valve (50) does not protrude from the outer peripheral surface of a closed housing (1) of a compressor, in which a compression mechanism, incorporated in a closed housing, is driven by an external drive source via an electromagnetic clutch.

The means for achieving the above object is to assemble the relief valve (50) to the closed housing (1) in such a manner that the relief valve (50) does not protrude from the outer peripheral surface of the housing (1) in order to discharge gas to the outside when the gas pressure in the closed housing (1) increases abnormally.

5 Claims, 2 Drawing Sheets

RELIEF VALVE WHICH DOES NOT PROTRUDE BEYOND A COMPRESSION HOUSING

2. FIELD OF THE INVENTION AND RELATED ART STATEMENT

The present invention relates to a compressor incorporated in a vehicular air conditioner, and the like, which is installed in a limited space.

An example of a compressor of this type relating to the present invention is shown in FIG. 3.

In FIG. 3, a closed housing 1 consists of a cup-shaped body 2 and a cylindrical member 6 fastened thereto with bolts.

A rotation shaft 7 passing through the cylindrical member 6 is rotatably supported in the closed housing 1 by bearings 8 and 9.

A fixed scroll 10 and an orbiting scroll 14 are disposed in the closed housing 1.

The fixed scroll 10 has an end plate 11 and a spiral wrap 12 installed on the inner surface of the end plate 11. The end plate 11 is fastened to the cup-shaped body 2 with bolts (not shown).

By bringing the outer peripheral surface of the end plate 11 into close contact with the inner peripheral surface of the cup-shaped body 2, the closed housing 1 is partitioned, a high pressure chamber 31 being defined on the outside of the end plate 11, and a low pressure chamber 28 being defined on the inside of the end plate 11.

At the center of the end plate 11 is formed a discharge port 29, which is opened/closed by a discharge valve 30.

The orbiting scroll 14 has an end plate 15 and a spiral wrap 16 installed on the inner surface of the end plate 15. The spiral wrap 16 has substantially the same shape as that of the spiral wrap 12 of the fixed scroll 10.

The orbiting scroll 14 and the fixed scroll 10 are engaged with each other so as to be off-centered by an orbiting radius and to be shifted 180 degrees as shown in the figure.

Thus, tip seals 17 embedded in the tip face of the spiral wrap 12 come into contact with the inner surface of the end plate 15, tip seals 18 embedded in the tip face of the spiral wrap 16 come into contact with the inner surface of the end plate 11, and the side surfaces of the spiral wraps 12 and 16 come into line contact with each other at plural places, by which a plurality of compression chambers 19*a* and 19*b* are formed so as to be substantially symmetrical with respect to the center of spiral.

A drive bush 21 is rotatably fitted, via an orbiting bearing 23, into a cylindrical boss 20 protrusively installed in the center of the outer surface of the end plate 15. An eccentric drive pin 25, which eccentrically protrudes from the inner end of the rotation shaft 7, is slidably fitted into a slide groove 24 formed in the drive bush 21.

A balance weight 27 for counteracting the dynamic imbalance caused by the orbital motion of the orbiting scroll 14 is installed to the drive bush 21.

Reference numeral 36 denotes a thrust bearing interposed between the outer peripheral edge of the end plate 15 and the inner peripheral edge of the cylindrical member 6, 26 denotes a rotation checking mechanism consisting of an Oldham's coupling which checks the rotation of the orbiting scroll 14 though allowing the orbital motion thereof, and 35 denotes a balance weight fixed to the rotation shaft 7.

By engaging an electromagnetic clutch 37, the power from a running engine (not shown) is transmitted to the rotation shaft 7 through the electromagnetic clutch 37.

When the rotation shaft 7 is rotated, the orbiting scroll 14 is driven via an orbiting drive mechanism consisting of the eccentric drive pin 25, slide groove 24, drive bush 21, orbiting bearing 23, boss 20, and the like. The orbiting scroll 14 performs orbital motion on a circular orbit with the orbiting radius, that is, a radius corresponding to the eccentricity between the rotation shaft 7 and the eccentric drive pin 25 while the rotation of the orbiting scroll 14 is checked by the rotation checking mechanism 26.

Then, the line contact portion between the side surfaces of the spiral wraps 12 and 16 gradually moves toward the center of spiral. As a result, the compression chambers 19*a* and 19*b* move toward the center of spiral while the volume thereof is decreased.

Accordingly, the gas flowing into the low pressure chamber 28 through a suction port (not shown) is introduced into the respective compression chambers 19*a* and 19*b* through the outer peripheral end opening of the spiral wraps 12 and 16, and reaches a central chamber 22 while being compressed. Then, the gas passes through the discharge port 29 and discharged into the high pressure chamber 31 by pushing and opening the discharge valve 30, and then flows out to the output side through a discharge pipe (not shown).

When the orbiting scroll 14 performs orbital motion, the orbiting scroll 14 is subjected to a centrifugal force directing to the eccentric direction and a gas pressure due to the compressed gas in the compression chambers 19*a* and 19*b*. The resultant force of these forces pushes the orbiting scroll 14 in the direction such that the orbiting radius increases, so that the side surface of the spiral wrap 16 comes into close contact with the side surface of the spiral wrap 12 of the fixed scroll 10, which checks the leakage of gas in the compression chambers 19*a* and 19*b*.

As the side surface of the spiral wrap 12 and the side surface of the spiral wrap 16 slide while being in close contact with each other, the orbiting radius of the orbiting scroll 14 changes automatically, and accordingly the eccentric drive pin 25 slides in the slide groove 24.

A relief valve 50 is installed to the high pressure chamber 31 of the cup-shaped body 1. When the pressure in the high pressure chamber 31 increases abnormally, the relief valve 50 is opened to discharge the gas in the high pressure chamber 31 to the outside.

When the above-described compressor is installed in an engine room, the relief valve 50 collides or interferes with other equipment in the engine room, so that the compressor cannot be installed, because the relief valve 50 protrudes from the closed housing 1 to the outside.

3. OBJECT AND SUMMARY OF THE INVENTION

The present invention was made in view of the above-mentioned situation, and an object of the present invention is to provide a compressor for solving the above problem.

Accordingly, the gist of the present invention is to provide a compressor, in which a compression mechanism incorporated in a closed housing, is driven by an external drive source via an electromagnetic clutch, the compressor being characterized in that a relief valve is assembled to the closed housing in such a manner that the relief valve does not protrude from the outer peripheral surface of the housing in order to discharge gas to the outside when the gas pressure in the closed housing increases abnormally.

Another feature of the present invention is that the relief valve is assembled to the closed housing by screwing it from the inside of the housing.

Still another feature of the present invention is that the relief valve is assembled to the closed housing from the outside of the housing, and fixed by screwing a hexagon socket nut.

4. BRIEF DESCRIPTION OF THE DRAWINGS

5. DETAILED DESCRIPTION OF A PREFERRED EMBODIMENTS

Preferred embodiments of the present invention will typically be described in detail with reference to the accompanying drawings.

Figure 1:
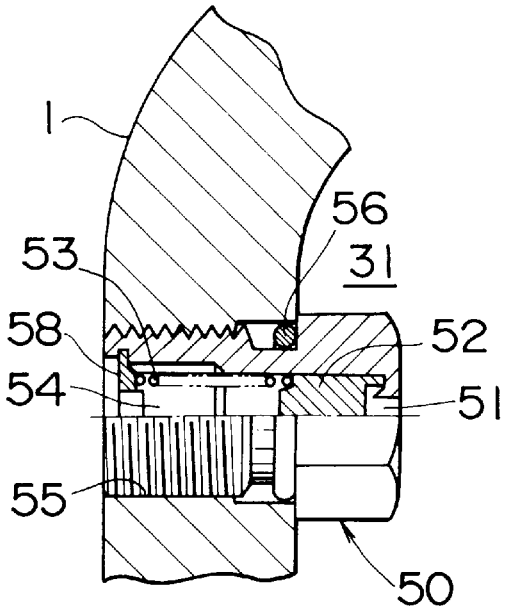
FIG. 1 is a partial sectional view showing a first embodiment of the present invention.

A first embodiment of the present invention is shown in FIG. 1.

The relief valve 50 is screwed into a threaded hole 55, which is formed in the closed housing 1 and passes therethrough, from the inside of the housing 1, and sealing is provided by an O-ring 56.

When the gas pressure in the high pressure chamber 31 increases abnormally, the gas in the high pressure chamber 31 enters the relief valve 50 through a high-pressure side inlet 51, and a valve piston 52, which is been pushed by a coil spring 53, is pushed and opened by the pressure of this gas, so that the gas blows off to the outside through a hole 54. Reference numeral 58 denotes a spring seat for the coil spring 53.

This relief valve 50 is assembled to the closed housing 1 in such a manner that the valve 50 does not protrude from the outer peripheral surface of the housing 1, so that the outside dimension of the compressor is decreased. Therefore, when the compressor is installed in the engine room, the relief valve 50 can be prevented from colliding or interfering with other equipment.

Figure 2:
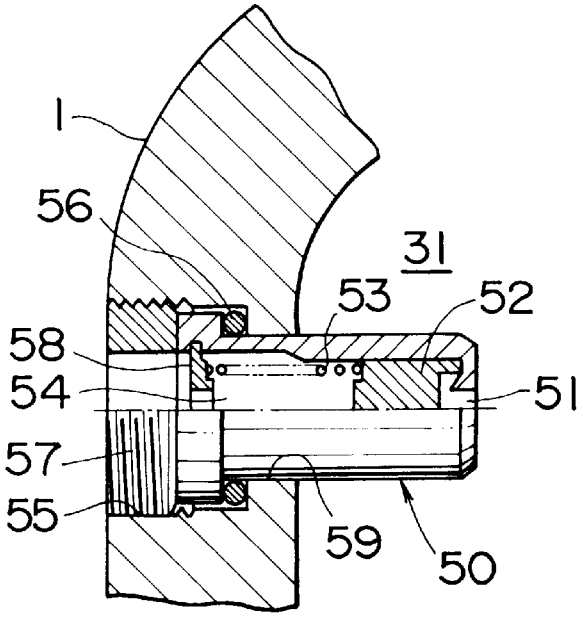
FIG. 2 is a partial sectional view showing a second embodiment of the present invention.
Figure 3:
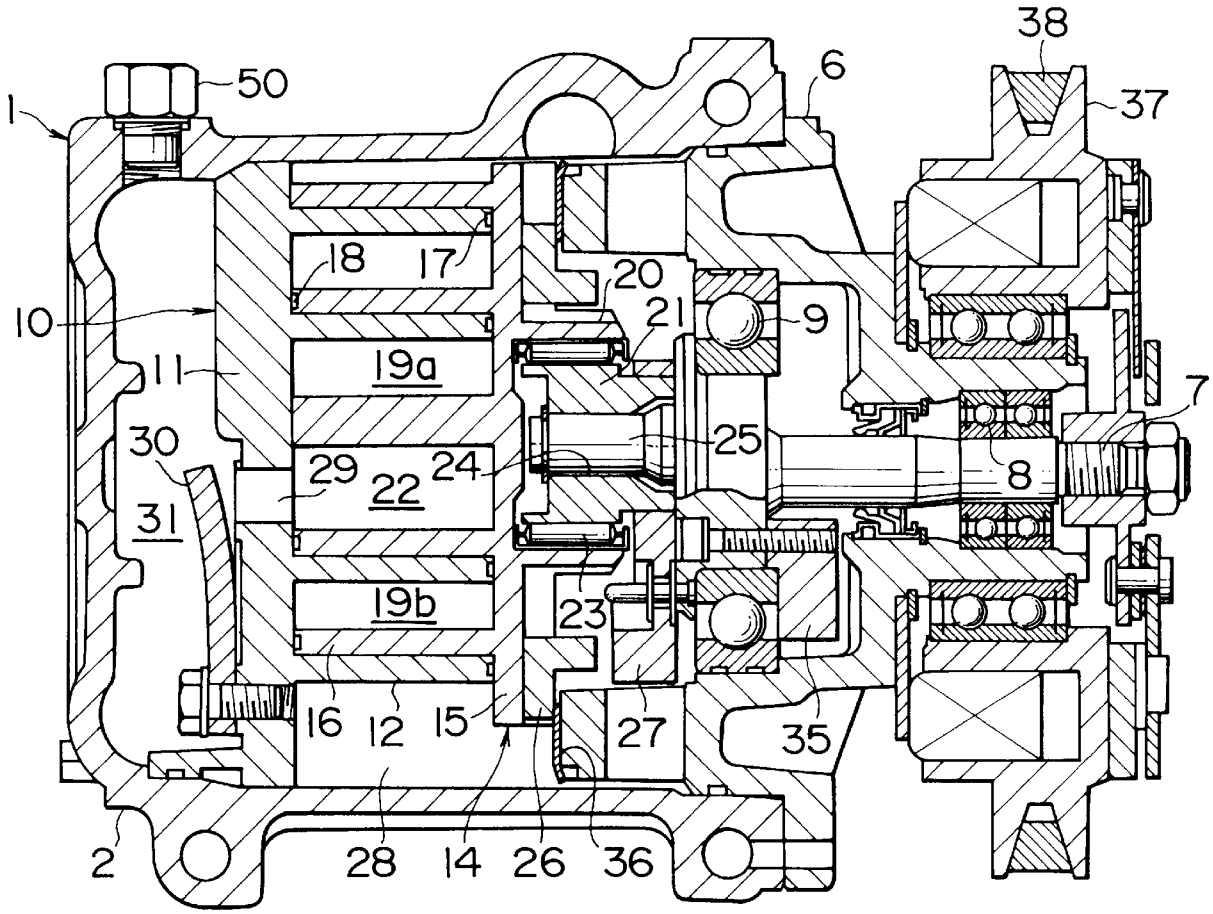
FIG. 3 PRIOR ART
FIG. 3 is a longitudinal sectional view of a conventional compressor.

A second embodiment of the present invention is shown in FIG. 2.

In this second embodiment, the relief valve 50 is inserted from the outside of the closed housing 1 into a through hole 59 formed in the housing 1, and then a hexagon socket nut 57 is screwed into a threaded hole 55, by which the relief valve 50 is pressed against the closed housing 1, and sealing is provided by an O-ring 56.

As is apparent from the above description, according to the present invention, since the relief valve is assembled to the closed housing in such a manner that the relief valve does not protrude from the outer peripheral surface of the housing, the outside dimension of the compressor is decreased and the relief valve is prevented from colliding or interfering with other equipment. Therefore, the compressor can be installed easily even in a limited space.

Also, if the relief valve is assembled to the closed housing by screwing it from the inside of the housing, the construction can be simplified.

Further, if the relief valve is assembled to the closed housing from the outside of the housing and it is fixed by screwing the hexagon socket nut, the relief valve can be assembled easily.

We claim:

1. A compressor, comprising:

a closed housing;

a compression mechanism incorporated in said closed housing, said compression mechanism being driven by an external drive source; and a relief valve mounted directly onto said closed housing, and adapted to discharge compressed gas to the outside of said closed housing when the gas pressure in said closed housing exceeds a predetermined value, wherein at least a portion of said relief valve forms a common flat surface with an outer peripheral surface of said closed housing, and wherein said relief valve is assembled to said closed housing by screwing said relief value from the inside of said closed housing.

2. A compressor according to claim 1, wherein said compression mechanism is driven by the external drive source via an electromagnetic switch.

3. A scroll type compressor, comprising:

a closed housing;

a compression mechanism incorporated in said closed housing, said compression mechanism having a fixed scroll and an orbiting scroll, each of which including an end plate and a spiral wrap installed on said end plate, being engaged with each other with said wrap, and said orbiting scroll performing an orbital motion with respect to said fixed scroll by an external drive source; and a relief valve mounted directly onto said closed housing, and adapted to discharge compressed gas to the outside of said closed housing when the gas pressure in said closed housing exceeds a predetermined value, wherein at least a portion of said relief valve forms a common flat surface with an outer peripheral surface of said closed housing, and wherein said relief valve is assembled to said closed housing by screwing said relief value from the inside of said closed housing.

4. A scroll type compressor according to claim 3, wherein said compression mechanism is driven by the external drive source via an electromagnetic switch.

5. A compressor, comprising:

a closed housing having a compression mechanism installed therein, said housing having a port which connects a compression chamber in said closed housing and an outside of said closed housing; and a relief valve inserted directly into said port from the inside of said closed housing, wherein at least a portion of said relief valve, when installed, forms a common flat surface with an outer peripheral surface of said closed housing.

* * * * *